United States Patent [19]

Brandi et al.

[11] Patent Number: 4,543,014

[45] Date of Patent: Sep. 24, 1985

[54] OFF-SHORE MOORING STRUCTURE

[75] Inventors: Roberto Brandi; Francesco Di Lena, both of Padua; Silvestro Vanore, Venezia-Mestre, all of Italy; Tor Naess, Vøyenenga; Paul U. Schamaun, Oslo, both of Norway

[73] Assignee: Norsk Agip A/S, Oslo, Norway

[21] Appl. No.: 393,310

[22] Filed: Jun. 29, 1982

[30] Foreign Application Priority Data

Jul. 16, 1981 [IT] Italy ..... 22972 A/81

[51] Int. Cl.[4] ..... B63B 21/00; B63B 35/40; E02B 17/00; E02D 5/62

[52] U.S. Cl. ..... 405/207; 405/202; 405/225; 114/230

[58] Field of Search ..... 405/195, 202-205, 405/207, 208, 224, 225, 227; 114/230

[56] References Cited

U.S. PATENT DOCUMENTS

| | | | |
|---|---|---|---|
| 3,667,239 | 6/1972 | Mott | 405/202 |
| 3,714,788 | 2/1973 | Mott | 405/205 |
| 3,832,857 | 9/1974 | Bassett | 405/225 |
| 3,996,754 | 12/1976 | Lowery | 405/207 X |
| 4,175,890 | 11/1979 | Taylor | 405/207 X |
| 4,234,270 | 11/1980 | Gjerde et al. | 405/207 X |

FOREIGN PATENT DOCUMENTS

| | | | |
|---|---|---|---|
| 2550621 | 5/1977 | Fed. Rep. of Germany | 405/224 |
| 1439387 | 6/1976 | United Kingdom | 405/207 |
| 1557424 | 12/1979 | United Kingdom | 405/207 |

*Primary Examiner*—Cornelius J. Husar
*Assistant Examiner*—Nancy J. Stodola
*Attorney, Agent, or Firm*—Hedman, Gibson, Costigan & Hoare

[57] ABSTRACT

A monolithic structure for off-shore mooring composed of a broadened foundation (2) and an emerging vertical structure (1) having a very slender character and a flexural resistance modulus decreasing from the bottom towards the surface. This structure has a buoyancy chamber (15) placed in a submerged position and close to the top end.

7 Claims, 6 Drawing Figures

OFF-SHORE MOORING STRUCTURE

This invention relates to off-shore mooring of watercraft, more particularly for loading and unloading by connection to subsea pipelines laid on very deep sea beds. The problem is especially connected with the exploitation of oilfields situated off-shore and on very deep sea beds, but the mooring structure according to the invention can be used with advantage also for other purposes.

The conventional art provides, for such a problem, approaches which are mainly based on buoy systems connected to the sea bed by chains, with tubular legs or latticework legs with articulations such as to have the connections to the sea bottom working essentially under pulling stresses.

The horizontal pull stresses imparted to the mooring structure cause the buoy to be displaced so that it becomes more deeply immersed. As the pulling stress is discontinued, the buoy tends to be brought back to its original posture by the buoyancy which has been originated by the deeper immersion.

In this connection, the following prior art disclosure can be cited, namely the French Pat. Nos. 2 137 117, 2 159 703, 2 187 596, 2 200 147, 2 307 949, 2 367 654, 2 375 087 and 2 386 758, and the U.S. Pat. Nos. 3,407,416, 3,614,869 and 3,899,990.

The systems in question originate serious problems when connecting the pipeline which conveys the fluid from the bottom to the surface in correspondence with the articulation, especially if the sea bed is very deep.

Such a connection can be embodied by hoses which, however, undergo considerable stresses, both due to the fatigue induced by repeated bendings and to the squeezing pressure when the hose is empty, the latter pressure being susceptible of becoming prohibitive on very deep sea beds.

Another possible mode of connection is that using articulated joints.

On the articulated joint approach there are numerous patents such as the French Pat. Nos. 2 367 000, 2 377 546, 2 348 428, 2 406 746 and the British Pat. No. 1 549 756.

The adoption of articulation joints at high depths originates a number of problems both due to the variety and the magnitude of the stresses the joints are supposed to withstand and to their positioning and upkeep.

The connection joints adopted most frequently are of the spherical or the Cardan type since they are required to be rotated in all directions. The sealtightness of such joints is a source of many problems.

The types of connection which are most heavily stressed should always be fitted with a barrier valve for effecting manipulations on the joint. This valve, which is very bulky and must be automatically controllable, is a source of complications and cost increase.

For these reasons, especially when the mooring structure must be installed at high depths, that is over 200 meters, the structures as provided by the known art have a number of defects both as to the operations necessary for their erection and as to their practical use.

The most serious difficulties are experienced in the hinge which secures the structure to the sea bottom and the connection of the pipeline laid on the sea bed to the pipeline which comes from the surface. Such movable component parts are subjected to considerably high stresses and their upkeep, or replacement if necessary, involves very high costs both from the point of view of operation and in terms of lost output.

It is sufficient to consider, in this connection, that, when the mooring facility is not available for crude oil loading, the exploitation of the off-shore oil field concerned must be discontinued and the tanker ships which cannot load remain unused.

In the case in which the conveyance members from the bottom to the surface are required to convey, rather than a liquid phase, a slurry composed of solids in suspension, the problems involved with the joints become more and more serious.

The tanker ship is secured to the mooring structure, usually ahead by one or more cables. The ship can rotate about the mooring point so as to minimize the stresses due to wind thrust, sea currents and waves impinging thereon and thus stressing the entire mooring structure.

The mooring structure according to the invention consists of a vertical structure having a very slender profile and a variable cross-section, which is characterized by a high flexibility and has a flexural resistance modulus which decreases from bottom to top.

The structure comprises a cylindrical tower (FIG. 1) having a varied cross-section, or a latticework structure (FIG. 2), or a combination of the two structural patterns. Such a vertical structure is rigidly connected to a broadened base foundation block placed on the sea bottom and stably positioned thereon due to its own weight and/or due to its being secured to the sea bed by foundation poles driven thereinto.

The slender vertical structure can be made of steel or reinforced concrete, or a combination of such two materials.

In addition, it can be stabilized by an inert material which can be introduced therein before, or also after, the launching of the structure, using specially provided hollow spaces thereof.

The vertical structure emerges and supports at its top end a rotary table to which the installations required for mooring and ship loading are secured. Such installations comprise, in addition to the rotary table aforementioned which permits that the structure may be oriented along the direction of the cable pull when mooring the ship, a rotary joint in order to make possible the flow of the fluid irrespective of the orientation of the superstructure, a loading boom to support, above the bow of the moored ship, the loading hoses connected to the rotary joint.

Moreover, the superstructure may receive other installations such as machines for pumping and metering the crude flow, safety and communication apparatus, emergency dwellings for the attendants charged with upkeep and operation and the helicopter landing area for the transportation of personnel to and from the structure.

The configuration, the embodiment in practice and the use of such installations are just the conventional ones.

Figure 3:
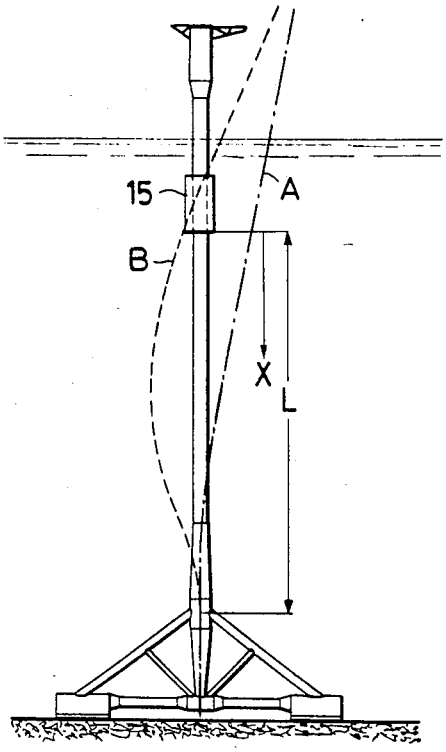
FIG. 3 is a side elevation of a mooring structure which shows the bouyancy body.

According to the preferred embodiment as depicted in FIG. 3, the slender vertical structure has a buoyancy chamber secured thereto and preferably at a depth, p, as defined by the formula $$p=K_1L$$

wherein $K_1$ varies from 0.12 to 0.30, the preferred range being between 0.15 and 0.20, L is the overall length of the mooring structure, the distance p being considered from the top towards the bottom.

Such a buoyancy chamber affords considerable advantages. A first advantage is to produce, as the structure undergoes a pull, a counteracting moment which tends to bring the structure to its vertical posture back again. In addition to that, the surface of the buoyancy chamber acts like a hydrodynamic dampening member to counteract the swinging motions of the structure.

The buoyancy thrust, furthermore, has a considerably attenuating effect towards the combined bending and compressing stresses which are considerable in so slender a structure.

In the embodiment now considered, the variation of the resisting cross-sections along the axis of the structure is made, in the portion between the buoyancy chamber and the point of connection of the mooring structure to the foundation block, consistently with the formula:

$$\frac{\tau}{\tau_o} = 1 + K_2\left[\frac{x}{L_o}\right]^2$$

wherein, reference being had to FIG. 3, J is the flexural moment of inertia of the cross-section concerned, having a distance x from the buoyancy chamber, $J_o$ is the flexural moment of inertia in the cross-section placed at the connection of the structure to the buoyancy chamber, $L_o$ is the distance between the buoyancy chamber and the point at which the structure is connected to the foundation block, and $K_2$ is a numerical coefficient (no dimensions) variable from 1.6 to 2.5 and preferably comprised between 1.9 and 2.1.

Such a law of variation as expressed by the formula reported above permits that the materials may be exploited according to constant coefficients and that wastes or oversizing of component parts may be prevented.

In practice, the slender structure is built with discrete portions having a constant cross-sectional dimension. The trend of the flexural moments of inertia, and thus of the resistance moduli (flexural) along the vertical axis of the mooring structure is thus that of a broken line in agreement with the formula reported above.

In the case in which the structure is composed of tubular structural members, the variation of the flexural moment of inertia can be obtained by building the several discrete portions with different diameters and/or wall thicknesses.

In the case in which the structure is built according to a latticework pattern, the characteristics of stiffness of the lattice sections will be varied by changing the design and/or the cross-sectional areas of the individual truss components.

A quite characteristic feature of the mooring structure according to this invention is that the emerging slender structure, which, together with the foundation block and the mooring cables, makes up the basic element for securing the tanker ship to the sea bottom and which is also a structure for supporting the machinery as required for the mooring and loading operations, is rigidly fastened to the foundation and provides, by virtue of the distribution of the moments of inertia therealong, a static and dynamic behaviour which is extremely advantageous.

Such behaviours are radically different from those of the conventional art as discussed hereinabove.

The structure according to the invention has a static behaviour corresponding to a resilient rebound characteristic for the structure, as a function of the mooring stress typically comprised between 6 and 20 metric tons per meter of displacement (at the level of the mooring location proper) consistently with the environmental conditions and the size of the ship concerned.

Such a structural "yieldability" has proven to be very useful both to limit the pulling loads in the mooring cables when the ship is moored (and thus exposed to the thrusts of the waves and the wind) and thus pulls and releases the cables, and to limit the localized bumping stresses in the case of an accidental bump of the ship when approaching the mooring place for placing the mooring cables and the crude loading hoses in position.

The dynamic behaviour of the structure, especially for use on very deep sea beds such as those over 300 meters, is definitely peculiar.

As a matter of fact, the structure has a first natural swinging mode, shown in FIG. 3 at A, which has a period longer than 35 seconds, that is a period longer than the maximum period length as is known from oceanographic observations.

The structure in question has a second swinging mode, which is indicated at B in FIG. 3, which has, along with the swinging modes of higher order, a period of its own which is shorter than 7 seconds, that is shorter than the period of possible waves of small period but with a significant impact strength. In FIG. 3 also the buoyancy chamber 15 has been shown.

The characteristic slender outline of the structure according to this invention ensures that, for the first swinging mode, the structure has both the appropriate resistance in the static behaviour, and a low dynamic amplification factor for all of the swinging modes.

This is due to the fact that the possible proper swinging periods are different in a sharp manner from the field of the periods of the possible waves having a high impact strength.

Thus, the occurrence of considerable resonance phenomena is prevented and, consequently, the occurrence of fatigue stresses at the points in which the stresses concentrate.

In order that such a behaviour relative to the dynamic stresses may fully be appreciated, it is fitting to consider that the slender structure according to the invention undergoes stresses having a cyclical nature as caused by the environmental conditions, such as the wave motions, the pull of the mooring howsers and the wind thrust.

An elastic structure subjected to pulsatory stresses can vibrate according to a very great number of swinging modes, which are identified by the circumstance that the lines of maximum elastic deformation have an increasing number of "nodes", that is, of points of intersection with the vertical line which is the undisturbed condition configuration.

In FIG. 3 there have been indicated the first two swinging modes which are the most significant from the point of view of the energetic magnitude of the stresses.

In the geographical areas of greatest interest the distribution of the wave periods for waves having the most significant power contents varies between 6 and 20 seconds. To prevent phenomena of dynamic reinforcement of the oscillation of the structure it is necessary that the natural period of oscillation of the structure, according to any of the possible modes of oscillation thereof, is the farthest possible from the periods proper of the impinging waves.

To prevent resonance phenomena of the kind referred to above, the offshore structures of the conventional art have periods proper of vibration which are reasonably lower than the periods of the significant forces originated by the waves. Such structures have maximum displacements close to the conditions of static load relative to the magnitude of the wave forces at every instant of time.

This requirement involves a much stiffer structure as well as the use of a greater amount of building materials.

With the structure according to the invention, conversely, the result is that, for the first oscillation mode-reported as A in FIG. 3, and in the case of actual practical interest in deep waters (250 m–500 m of depth) the structure as such as a proper period of swinging which is considerably longer than that of the longest waves that is the waves the period of which is the longest. Under such conditions, the structure behaves like a flexible or yieldable structure that is a structure which is capable of accompanying with its elastic deformations the variable field of wave forces, thereby reducing the magnitude of the hydrodynamic forces which are actually transferred to the structure.

For the second swinging mode, indicated as B in FIG. 3 and still more intensely for the swinging modes of the high orders, the result is that the natural period is shorter than that of the small-period waves but the energetic contents is still considerable so that such waves can stress the structure in a significant way.

This fact takes place principally in the field of the waves and thus of the loads which are capable of impressing fatigue stresses to the structure, because of the high number of probabilities of having to do with waves having such characteristics.

The particular position of the buoyancy chamber is such as to produce the effect of increasing the period proper relative to the swinging mode A because such a mode favourably influences the inertial characteristics of the elastic system as represented by the structure in question. Conversely, for the second swinging mode, inasmuch as the buoyancy chamber is located near a node of the maximum elastic deformation line, said chamber does not influence the features of the system considerably so that the swinging period relative to that mode is virtually unaffected.

By way of illustration without limitation, a few possible embodiments of the structure according to the invention will now be described hereinafter.

Figure 1:
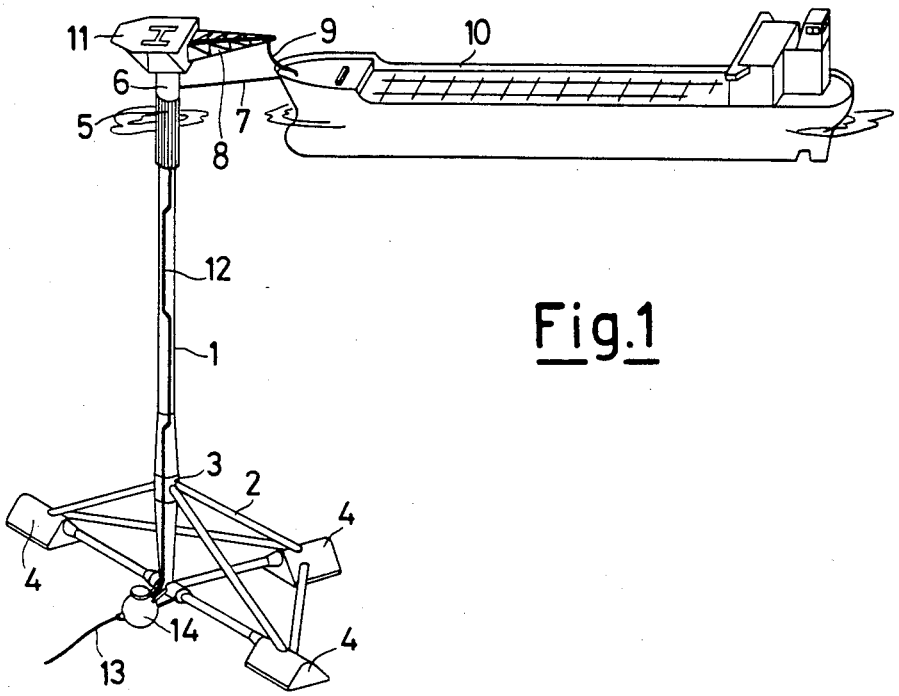
FIG. 1 is a perspective view of a mooring structure.

In FIG. 1, the slender emerging structure 1, is rigidly secured to a foundation block 2 as composed of a lattice work made of tubular members.

The cross-section 3 is the section at which there is rigid insertion connection relative to the foundation block and it will have the greatest stiffness relative to the other cross-sections, as considered by proceeding from bottom to top.

The foundation block 2 rests on the sea bed by the foundation bases 4 (three in the configuration shown in the examples).

The weight of the structure, completed with a ballast, is sufficient to counteract with the end reactions the normal forces and the upturning moments due to the weight of the structure, to the external causes in action and the environmental conditions, such as wind force, currents, waves, or the working conditions such as the pull of the mooring cables, accidental overloads and others.

As an alternative to the exploitation of the own weight, the bases 4 can be secured to poles driven into the subsea ground by hammering with a subsea hammer and subsequent cement injection.

To the top end of the emerging slender structure, the rotary table 5 is secured and, on it, there are supported the superstructures 6 with the attendant diagrammatically symbolized machinery, viz. the mooring howser 7, the loading boom 8, the hoses 9 for transferring the crude oil to the moored tanker ship, the helicopter landing area 11.

One or more conduits 12, housed in the vertical structure connects the bottom to the surface and is united to the pipeline laid on the sea bottom 13. The connection system for the two pipeline sections aforementioned can be made by a welded joint placed within a sealtight compartment 14 which can be maintained under atmospherical pressure and to which the operator may have access by caisson-like bells.

Figure 2:
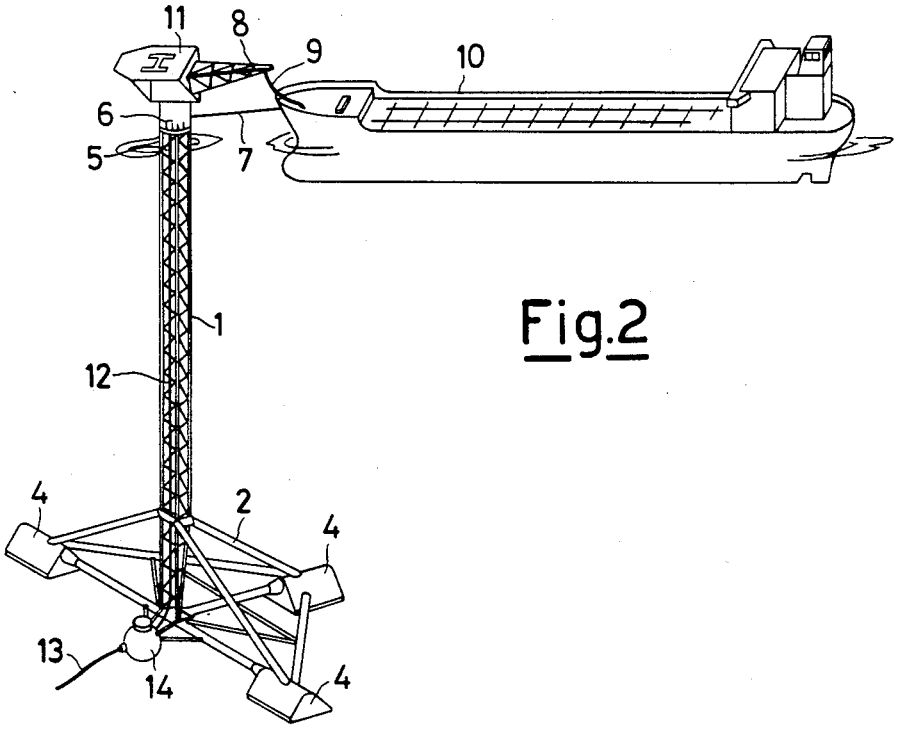
FIG. 2 is a perspective view of a mooring structure.

FIG. 2 illustrates the case in which the emerging slender structure is embodied by an open-meshed latticework structure or truss.

For this FIGURE, the same reference numerals have been adopted as for FIG. 1 and the same considerations apply.

Figure 4:
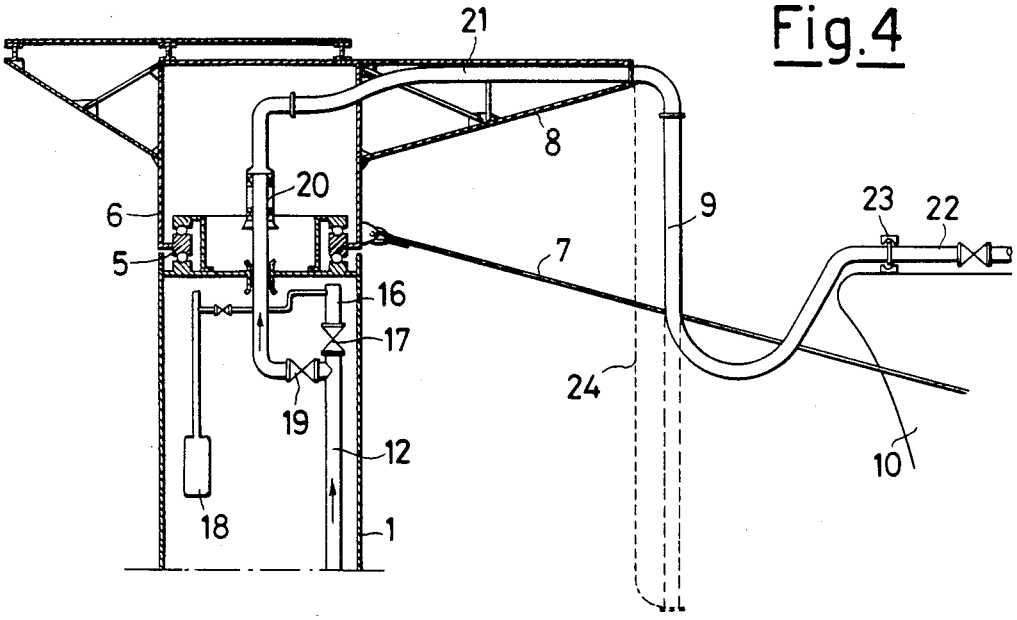
FIG. 4 is a diagrammatic cross-section of the upper end of the mooring structure.

FIG. 4 is a diagrammatical showing of the end portion of the mooring structure.

The top end portion of the structure 1 is connected to the superstructure 6 by the rotary table 5, or bearing, which permits rotations about the vertical axis.

The vertical pipeline 12 for conveying the product has a device 16 for grasping and inserting the so-called "pigs" for the pipeline inner cleaning and for the displacement of duct, the device having an accessing valve 17 and a high-pressure pneumatic circuit 18.

The pipeline 12 is in communication, via the cutoff valve 19, with the rotary hydraulic joint 20, placed on the rotation axis of 6, for connecting the duct 21 supported by the loading boom 8 and a hose 9 is provided also.

The hose 9, in its turn, is connected, during the loading operations, with the pipelines 22 for loading the tanker ship 10, by means of the quick-lock joint 23.

The mooring cable 7 connected the superstructure 6 to the tanker ship 10.

Under conditions in which no loading operation are under way, the hose 9 is allowed to hang vertically with its end connected to a rope 24 which permits to haul the hose aboard.

From the foregoing description the significant advantage of the structure according to the invention lies in its submerged portion being completely monolithic and, as such, it does not require any sophisticated construction or special hydraulic and mechanical upkeep operations for the submerged portions; this was the critical point of the conventional structures as used hitherto.

The structure according to the invention can be constructed both simply and cheaply: in the following an erection procedure will be described along with the constructional procedure, by way of example only and without limitations: from this description the ease and the simplicity of the construction will become fully conspicuous.

Figure 5:
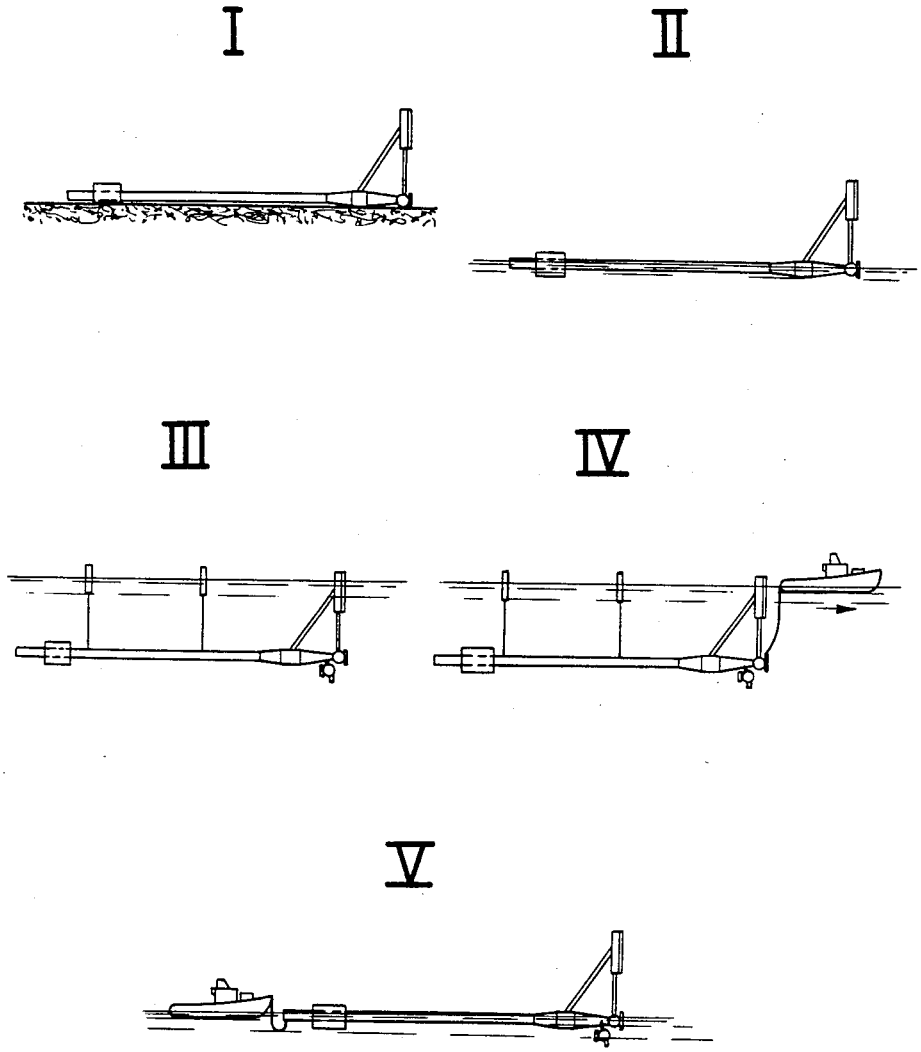
FIG. 5 is a diagram of the manufacturing, transporting erection techniques that may be used in connection with the mooring structure.
Figure 5:
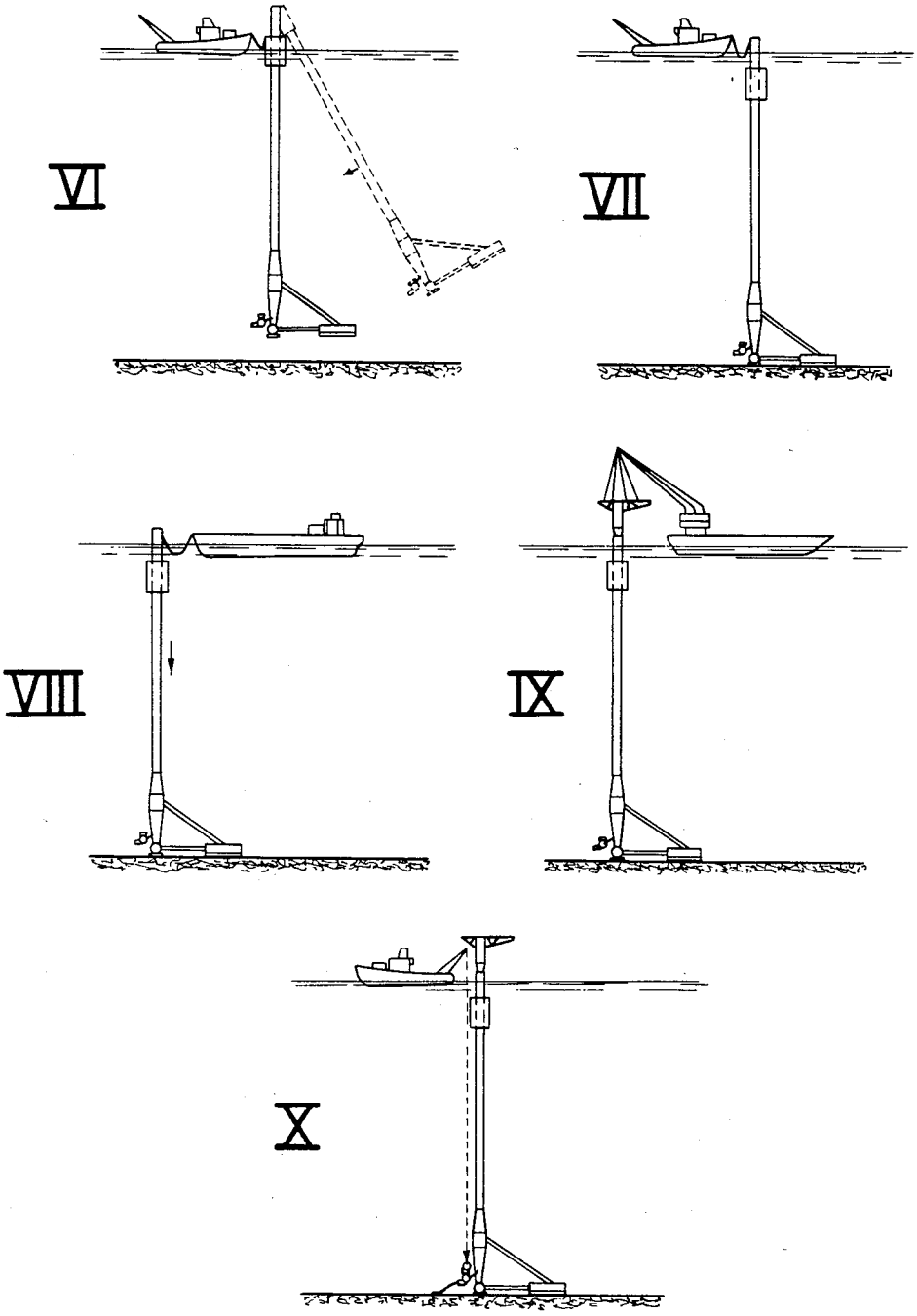

With reference now to FIG. 5, the construction and erection stages are the following. In the stage I the vertical structure and its foundation block are constructed in discrete sections having the appropriate length, in a shipyard. In the stage II such sections are launched separately and structurally connected when afloat, the operation being carried out in a confined water enclosure.

In the stage III the structure is then connected in a number of points to auxiliary floaters by cables or chains and is loaded, for example by flooding it partially by appropriate flooding valves until a stable horizontal submerged position is attained.

In such position the structure is towed (stage IV) to the installation site and the shipment in submerged position minimizes the dynamic bending action and thus stresses to the structure.

Once the erection site has been reached, the structure is restored to its floating condition again (stage V) by dumping the added weight, for example by displacing the ballast water which has been introduced during stage III, by compressed air fed by hoses from the depot barge, whereafter the auxiliary floaters are disconnected from the structure.

In stage VI a few compartments of the structure are gradually flooded so as to have it capsized until a stable vertical floating posture is attained. An additional introduction of ballast water, stage VII, permits to place the structure to rest on the sea bottom.

If the solution exploiting the weight is adopted, solid ballast is introduced, stage VIII, in the foundation bases to achieve the static stabilization of the entire structure: as an alternative, the bases may contain beforehand the necessary ballast quantity to make sure that, as the installation has been completed, there is stability on the bottom. In such case the foundation bases have buoyancy chamber which enable the bases to be shipped afloat, to be flooded subsequently during the laying operations.

The stability on the sea bottom can also be achieved by securing the foundation block to poles driven into the sea bottom ground and then cemented to the same block.

During the subsequent stages, there are mounted (stage IX) the intermediate structures by a crane mounted on a pontoon and (stage X) the connection with the sea bottom pipeline are made by using a caisson type machinery.

Figure 6:
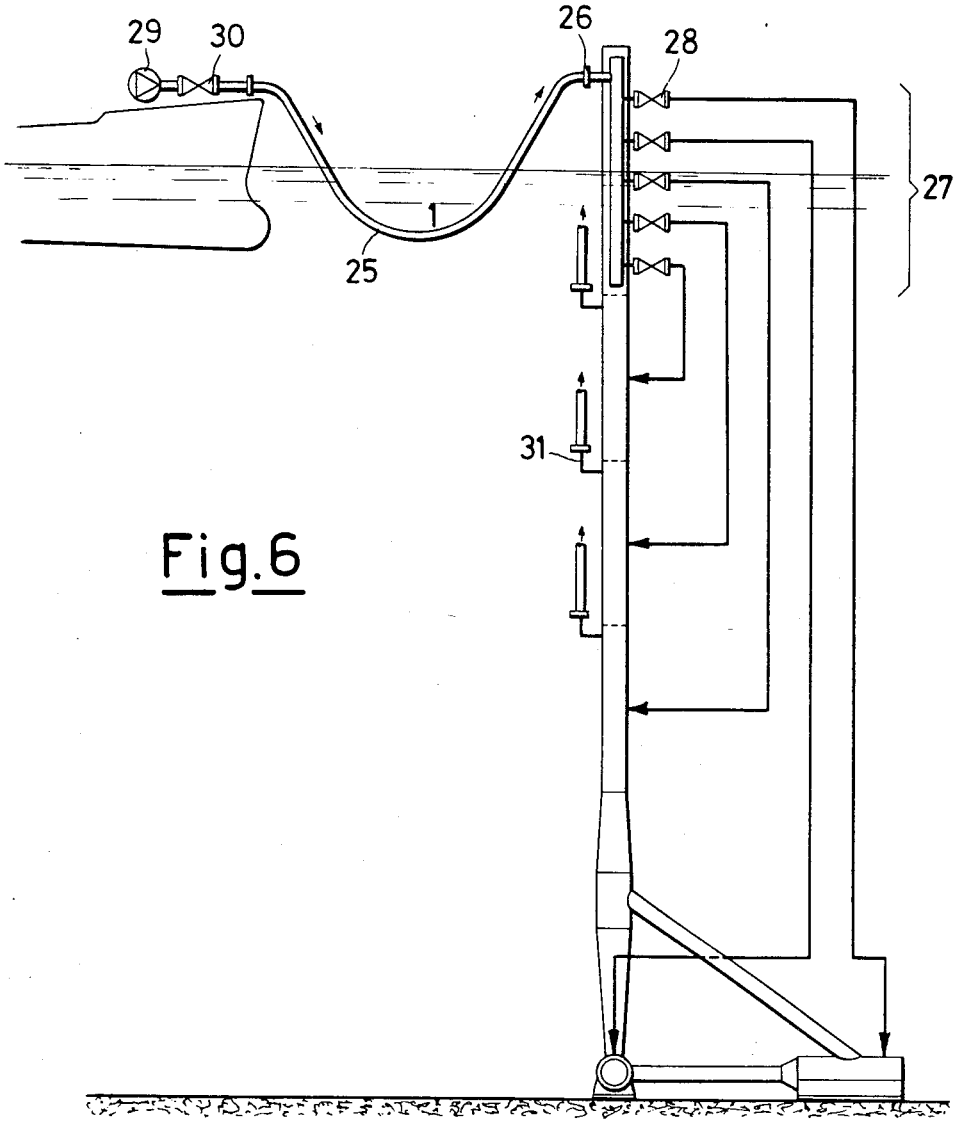
FIG. 6 is a diagram of the erection techniques that may be used in connection with the mooring structure.

In FIG. 6 there is shown by illustration without limitation a diagram of the ballast system which is used for the operation described above, both for shipping and for erection, according to which water is introduced first as a ballast, and solids for the same purpose thereafter.

For practical reasons, the solid ballast material is preferably slurried in water in a divided form such as granules of a discrete dimension, pebbles, or large grit dust. The water used for the conveyance is then drained through the escape valves.

A hose 25 is connected by the quick-lock joint 26 to the distribution system 27. From this system it is possible by valves controlled from a remote location 28, to send liquid or solid ballast material to the intended ballast compartment placed in the structure, by acting upon the pump 29 and the valve 30, both installed aboard the tanker ship.

The valves 31 permits to vent the air and/or to discharge the conveyance fluid in the case of an aqueous slurry of a solid ballast material.

We claim:

1. A structure for mooring ships offshore and loading them comprising an emerging portion equipped with mooring and loading facilities and an immersed portion, characterized in that said immersed portion is monolithic and is composed of a broadened rigid foundation block and a slender vertical structure having a flexural resistance modulus decreasing from the foundation block towards the sea surface, said vertical structure having a hollow buoyancy body located on the upper end of said slender vertical structure at a depth between 12% and the 30% of the length of said slender vertical structure between the sea surface and the foundation block, said structure further characterized in that the flexural moment of inertia of the slender vertical structure is increased in the portion between the buoyancy chamber and the point of connection with the foundation block according to the formula:

$$\frac{J}{J_o} = 1 + K_2\left[\frac{x}{L}\right]^2$$

wherein reference being had to FIG. 3 of the accompanying drawings, J is the flexural moment of inertia of a cross-section situated at a distance x from the buoyancy chamber, $J_o$ is the moment of inertia of the cross-section of connection with the buoyancy chamber, L is the length of the portion between the buoyancy chamber and the point of connection with the foundation block, $K_2$ is a coefficient (adimensional) comprised between 1.6 and 2.5.

2. A structure as defined in claim 1 wherein the buoyancy body is at a depth of between 15% and 20% of the length of said vertical slender structure between the sea surface and the foundation block.

3. A structure as defined in claim 1 wherein $K_2$ is comprised between 1.9 and 2.1.

4. Structure for offshore mooring according to claim 1, characterized in that the vertical structure is composed of a cylindrical structure having a cross-sectional area vaired in the lengthwise direction.

5. Offshore mooring structure according to claim 1, characterized in that the vertical structure consists of a tridimensional latticework structure.

6. Structure for offshore mooring according to claim 1, characterized in that in the vertical structure cylindrical component parts are connected to latticework component parts.

7. Structure for offshore mooring according to claim 1, characterized in that the structure is made of steel, reinforced concrete or steel and reinforced concrete.

* * * * *